United States Patent [19]

Muz

[11] Patent Number: 4,869,691

[45] Date of Patent: Sep. 26, 1989

[54] SOCKET FOR A MULTIPOLAR PLUG CONNECTOR FOR DIRECT SOLDERING ONTO OR INTO A PRINTED CIRCUIT BOARD

[75] Inventor: Edwin Muz, Reutlingen, Fed. Rep. of Germany

[73] Assignee: Nicolay GmbH, Fed. Rep. of Germany

[21] Appl. No.: 120,377

[22] Filed: Nov. 13, 1987

[30] Foreign Application Priority Data

Nov. 14, 1986 [DE] Fed. Rep. of Germany ..... 3638962

[51] Int. Cl.[4] ..... H01R 9/00

[52] U.S. Cl. ..... 439/686; 439/752

[58] Field of Search ..... 439/686, 690, 695, 701, 439/752

[56] References Cited

U.S. PATENT DOCUMENTS

| | | | |
|---|---|---|---|
| 3,500,295 | 3/1970 | Faber et al. | 439/686 |
| 3,668,615 | 6/1972 | Bury | 439/695 |
| 4,025,151 | 5/1977 | Eigenbrode | 439/752 |
| 4,171,152 | 10/1979 | Geiseler | 439/752 |
| 4,380,119 | 4/1983 | Normann et al. | 439/752 X |

FOREIGN PATENT DOCUMENTS

| | | | |
|---|---|---|---|
| 2348610 | 4/1975 | Fed. Rep. of Germany | 439/752 |

*Primary Examiner*—Eugene R. LaRoche
*Assistant Examiner*—Benny Lee
*Attorney, Agent, or Firm*—Wigman & Cohen

[57] ABSTRACT

A socket for a multipolar plug connector for direct soldering onto or into a printed circuit board with contact bodies arranged in compartments of an insulating contact carrier and having formed on them contact lugs which protrude beyond the socket comprises a clamping strip which is made of electrically insulating material and is arranged at a distance from the side of the contact carrier exhibiting the exit openings for the contact lugs. This clamping strip has a number of separate clamping points which correspond to the plurality of compartments and in which the contact lugs are fixed between their free end and the end connected to the contact body in a freely selectable arrangement with respect to the compartments.

8 Claims, 1 Drawing Sheet

II
II
1
8
5
8

1'
11
4
15
2
13
14
9''
9
9'
7
16
3
2
3
5
8
1
6

15
1'
4
10
13
9'
12
12
10
5
4

4
3

SOCKET FOR A MULTIPOLAR PLUG CONNECTOR FOR DIRECT SOLDERING ONTO OR INTO A PRINTED CIRCUIT BOARD

BACKGROUND OF THE INVENTION

The invention relates to a socket for a multipolar plug connector for direct soldering onto or into a printed circuit board, with contact bodies which are arranged in compartments of an insulating contact carrier and which have formed on them contact lugs which protrude beyond the socket.

In the known sockets of this kind, the connection pattern of the connection lugs, i.e., the position of the individual connection lugs relative to the contact bodies is predetermined by the structural design of the insulating parts. Hence the allocation of a contact body to a certain position in the connection pattern on the printed circuit board is also fixed.

Other allocations, therefore, require different insulating parts, as do different numbers of poles or another arrangement of the contacts in the contact carrier. This means not only lower numbers of units in the manufacturing process but also higher tool costs on account of the different tools.

SUMMARY AND OBJECTS OF THE INVENTION

In view of the foregoing limitations and shortcomings of the prior art devices, as well as the disadvantages not specifically mentioned above, a primary object of the invention is to provide a socket of the kind mentioned at the beginning which does not have these disadvantages, i.e., enables modifications.

Briefly described, the aforementioned object is accomplished according to the invention by providing a socket for a multipolar plug connector for direct soldering onto or into a printed circuit board, the socket comprising contact bodies which are arranged in compartments of an insulating contact carrier and which have formed on them contact lugs which protrude beyond the socket, and a clamping strip made of electrically insulating material and arranged at a distance from the side of the contact carrier exhibiting the exit openings for the contact lugs, said strip comprising a number of separate clamping points which correspond to the number of compartments in which the contact lugs are fixed between their free end and the end connected to the contact body in a freely selectable arrangement with respect to the compartments.

Due to the allocation of the contact lugs to the clamping channels of the clamping strip being freely selectable, all possible different connection patterns of the contact lugs are realizable without alteration of the insulating parts. To achieve this, the contact lugs need only be inserted into the desired clamping channels and then fixed by clamping in the assembly operation. Since the contact bodies are preferably arranged in a floating manner in the compartments of the contact carrier, the compartments can, furthermore, be fitted in a freely selectable manner. Hence also different numbers of poles and different arrangements of the contact bodies in the contact carrier are readily realizable without alteration of the insulating parts.

In order that the contact lugs are insulated from one another at the points of intersection which, as a rule, are unavoidable, insulating tubes can be provided in the intersecting sections. Insulation of the intersecting contact lugs from one another by means of insulating foil wafers is also very advantageous.

In a preferred embodiment, the clamping strip consists of two parts which can be tensioned against one another as such a clamping strip design enables all contact lugs to be fixed in a very simple manner.

If each clamping channel comprises in the one part thereof a groove extending transversely to the longitudinal direction of the channel and in the other part thereof a projection oriented towards this groove, closure of the clamping strip causes a deformation of the contact lugs in the form of a transverse groove, whereby they are reliably secured against longitudinal displacement.

The two parts of the clamping strip are advantageously arranged on a socket housing or on a cover closing one of its ends. In many cases, a configuration of the clamping strip having a comb-type shape for the formation of clamping channels is very expedient as it facilitates connection of the contact lugs to the printed circuit board.

In order that not only the connection pattern of the contact lugs but also the association of the angular position of the contact carrier with the socket housing can be freely selectable, in a preferred embodiment, the contact carrier is insertable into the socket housing in different angular positions with respect to it and cooperating locking elements secure the contact carrier in the selected angular position.

With the foregoing and other objects, advantages and features of the invention that will become apparent hereinafter, the nature of the invention may be more clearly understood by reference to the following detailed description of the views, the appended claims and to the several views illustrated in the attached drawings.

DESCRIPTION OF A PREFERRED EMBODIMENT

Figure 1:
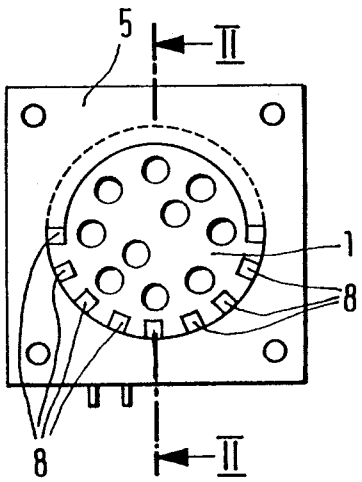
FIG. 1 is a plan view of the front side of the embodiment.
Figure 2:
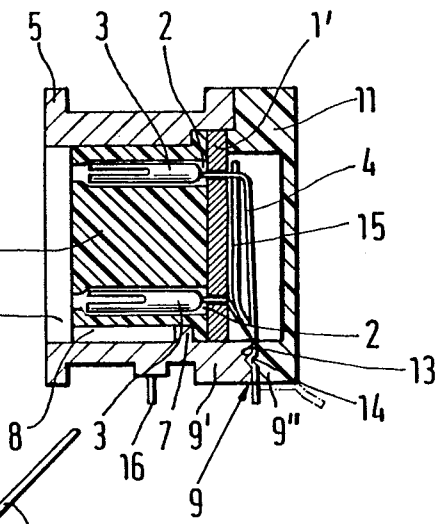
FIG. 2 is a sectional view taken on line II—II of FIG. 1.
Figure 3:
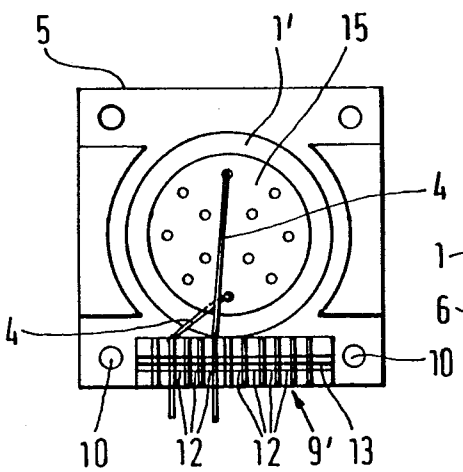
FIG. 3 is a plan view of the rear side with the cover removed.
Figure 4:
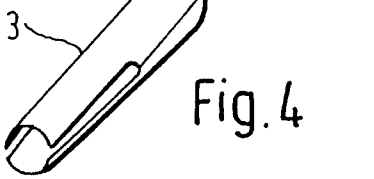
FIG. 4 is a perspective view of a contact body with a contact lug formed thereon.

Referring now in detail to the drawings wherein like parts are designated by like reference numerals throughout, there is illustrated in FIGS. 1–3 a socket for a multipolar plug connector for direct soldering onto or into a printed circuit board comprising a cylindrical contact carrier 1 which, as in the case of the other insulating parts, is a plastic injection molded article. The contact carrier 1 is provided with compartments 2 which lie parallel to its longitudinal axis and each accommodates in a floating manner a resilient contact sleeve 3 with a contact lug 4 integrally adjoining its rear end (see FIG. 4). The compartments 2 taper at the rear end of the contact carrier 1 formed by a plate 1' to a slot for passage of the contact lug.

A socket housing 5 which in the embodiment has a square external contour forms a cylindrical inner space 6 for accommodation of the contact carrie 1. A coding projection 7 formed as an integral part protrudes into the inner space 6 and engages one of the longitudinal grooves S which are provided on the outside of the contact carrier 1 and, in the embodiment, are offset with respect to one another by 22.5 degrees in the circumferential direction. The contact carrier 1 can thereby be inserted in different angular positions into the socket housing 5 and fixed therein.

The one of the four straight-lined edge zones forming the rear end of the socket housing 5 protruding beyond the plate 1' is constructed as a first, comb-type part 9' of a clamping strip designated in its entirety by 9 which, as is apparent from FIG. 3, terminates at a distance from a through-bore 10, at each end. A second part 9'' of the clamping strip 9 which can be pressed against the first part 9' is formed by a straight-lined section of the upright edge of a cover 11, similarly in the form of an injection molded article, which closes the rear end of the socket housing 5. As is apparent from FIG. 2, there is a sufficiently large space between the inner side of the cover 11 and the end surface of the contact carrier 1 facing it for accommodation of the contact lugs 4. The cover 11 has an external contour which is adapted to the socket housing 5 and, in the embodiment, is connected to the latter by screws, not illustrated, which penetrate the through-bores 10 and also two corresponding through-bores on the side opposite the clamping strip 9 and engage the socket housing 5. However, the cover 11 could also be adhered or welded to the socket housing.

The straight-lined clamping strip 9 extending transversely to the longitudinal direction of the socket housing 5 at one of its four sides has a number of clamping channels 12 which are arranged alongside one another and correspond in number to the compartments 2. One of the contact lugs 4 is, in each case, selectively inserted into one of the clamping channels in such a way that the free end section protrudes outwardly. If the protrusion is too large, an appropriate portion of the contact lug 4 is cut off.

In the abutment surface facing the second part 9'', the first part 9' is provided with a groove 13 which extends in the longitudinal direction of the clamping strip 9 and towards which a corresponding projection 14 of the second part 9'' is oriented. When the two parts 9' and 9'' are clamped together, the contact lugs 4 are, therefore, correspondingly deformed, whereby they are secured against longitudinal displacement.

As is apparent from FIG. 2, after emerging from the contact body 1, the contact lugs 4 are bent towards the clamping strip 9 and, as is evident from FIG. 3, guided towards the associated clamping channel 12. Since intersection of the contact lugs 4 is unavoidable, as is similarly apparent from FIG. 3, the bent sections of the contact lugs 4 lie between insulating foil wafers 15 which are provided for this purpose. The insulating foil wafers 15 have through-openings for the contact lugs 4 in the same arrangement as the compartments 2 in the contact carrier 1. Therefore, of the contact lugs 4 emerging from the contact carrier 1, first only a single one is bent and guided towards its clamping channel 12. A first insulating foil wafer 15 is then put on and it is penetrated by all of the contact lugs 4 which have not yet been bent. The second contact lug 4 is now bent and guided to its clamping channel 12. The next insulating foil wafer 15 is, in turn, penetrated by the contact lugs which have not yet been bent. The third contact lug is then bent, etc. The section of the contact lugs 4 protruding beyond the clamping strip 9 is, depending on whether the contact lugs are to be put through holes of the printed circuit board and soldered on the underside or are to be soldered on the upper side of the printed circuit board, cut to the necessary length and bent into the required shape, as is illustrated by unbroken and dashed lines in FIG. 1.

Bolts 16 or the like are formed on the socket housing 5 to enable it to be fixed on the printed circuit board.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A socket for a multipolar plug connector for direct soldering onto or into a printed circuit board, said socket having contact bodies which are arranged in compartments of an insulating contact carrier, said compartments extending in a plug-in direction and having access openings at a front side of the contact carrier for plugging in the multipolar plug and exit openings at an opposite rear side of said contact carrier, and said contact bodies having formed on them contact lugs extending through said exit openings and comprising free ends which protrude beyond the socket, said socket comprising:

a socket housing having a longitudinal axis extending in said plug-in direction, said socket housing being adapted to accommodate the contact carrier in different angular positions with respect to said longitudinal axis and to secure the contact carrier against axial movement along said longitudinal axis;

a clamping strip made of electrically insulating material and arranged in the plug-in direction at a distance from the rear side of the contact carrier;

said strip comprising a plurality of separate clamping points which correspond to the number of compartments and in which selected ones of the contact lugs are fixed between their free ends and their ends connected to the contact body; and said socket housing and said contact carrier comprise cooperating locking elements which positively engage one another for locking the rotation of the contact carrier about said longitudinal axis in selected angular positions.

2. The socket according to claim 1, wherein sat least one contact lug is insulated from another contact lug by at least one tube in the section between the clamping point and the point at which they emerge from the contact carrier.

3. The socket according to claim 1, wherein the contact lugs are insulated from one another in a lug lead section between the clamping point and the point at which they emerge from the exit opening of the contact carrier by insulating foil wafers which lie parallel to the rear side of the contact carrier, which lug lead section accommodates a bent section of at least one of the contact lugs and which is provided with through-openings for the contact lugs.

4. The socket according to claim 1, wherein the clamping strip comprises two parts which can be tensioned against one another.

5. The socket according to claim 4, wherein at least one part of the clamping strip has a comb-type shape for the formation of clamping channels, each of said channels being adapted to accommodate a selected one of the contact lugs to be clamped within the channel by cooperation with the other of the two parts of the clamping strip.

6. The socket according to claim 4, wherein each clamping point comprises in one part a groove extending transversely to the contact lug and in the other part a projection oriented towards this groove.

7. The socket according to claim 4, wherein one part of the clamping strip is formed on said socket housing and the other part on a cover which is connected to the socket housing at its rear side.

8. The socket according to claim 7, wherein the clamping channels of the clamping strip are arranged at the socket housing in a row alongside one another at right angles to the longitudinal axis of the socket.

* * * * *